US006796290B2

(12) United States Patent
Boehland et al.

(10) Patent No.: US 6,796,290 B2
(45) Date of Patent: Sep. 28, 2004

(54) FUEL INJECTION SYSTEM FOR AN INTERNAL COMBUSTION ENGINE

(75) Inventors: Peter Boehland, Marbach (DE); Godehard Nentwig, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 92 days.

(21) Appl. No.: 10/307,479

(22) Filed: Dec. 2, 2002

(65) Prior Publication Data

US 2003/0131825 A1 Jul. 17, 2003

(30) Foreign Application Priority Data

Nov. 30, 2001 (DE) ..... 101 58 660

(51) Int. Cl.[7] ..... F02M 33/04; F02M 57/02

(52) U.S. Cl. ..... 123/446; 239/88; 123/506; 123/299

(58) Field of Search ..... 123/446, 467, 123/514, 509, 299–300, 506; 239/88–91

(56) References Cited

U.S. PATENT DOCUMENTS 5,771,865 A * 6/1998 Ishida ..... 123/467
6,189,509 B1 2/2001 Froment
6,439,202 B1 * 8/2002 Carroll et al. ..... 123/467

FOREIGN PATENT DOCUMENTS

| | | |
|---|---|---|
| DE | 42 36 882 C1 | 4/1994 |
| EP | 0 740 067 A2 | 10/1996 |
| EP | 0 767 303 A1 | 4/1997 |
| EP | 0 909 892 A2 | 4/1999 |
| EP | 0 967 380 A2 | 12/1999 |
| EP | 0 992 675 A2 | 4/2000 |
| EP | 1 077 320 A2 | 2/2001 |

* cited by examiner

*Primary Examiner*—Thomas N. Moulis
(74) *Attorney, Agent, or Firm*—Ronald E. Greigg

(57) ABSTRACT

A fuel injection system having a high-pressure fuel pump and a fuel injection valve for each engine cylinder. A pump work chamber can be made to communicate with a pressure chamber of the injection valve having a valve member movable by pressure in the pressure chamber to control opening of at least one injection opening. A connection of the pump with a relief chamber is controlled by a first electrically actuated control valve, and a second control valve controls the pressure in a control pressure chamber, which pressure urges the injection valve in the closing direction. A blocking valve is disposed in the connection of the pump with the pressure chamber, and the connection of the pump with the relief chamber, in which the first control valve is disposed, leads away between the pump and the blocking valve.

31 Claims, 3 Drawing Sheets

FUEL INJECTION SYSTEM FOR AN INTERNAL COMBUSTION ENGINE

BACKGROUND OF THE INVENTION

1. Field of the Invention

The invention is directed to an improved fuel injection system for an internal combustion engine.

2. Description of the Prior Art

One fuel injection system of the type with which this invention is concerned is known from European Patent Disclosure EP 0 957 261 A1. This fuel injection system has one high-pressure fuel pump and one fuel injection valve, communicating with it, for each cylinder of the engine. The high-pressure fuel pump has a pump piston, which is driven to reciprocate by the engine and which defines a pump work chamber that can be made to communicate with a pressure chamber of the fuel injection valve, and this valve has an injection valve member by which at least one injection opening is controlled and which is movable by a pressure prevailing in the pressure chamber, counter to a closing force, in an opening direction for opening the at least one injection opening. A first electrically actuated control valve, by which a connection of the pump work chamber with a relief chamber is controlled, is provided. A second electrically actuated control valve is also provided, by which the pressure prevailing in a control pressure chamber, which pressure urges the injection valve member in the closing direction, is controlled. The control pressure chamber has a connection with the pump work chamber, and a connection of the control pressure chamber with a relief chamber is controlled by the second control valve. In this known fuel injection system, it is a disadvantage that the course of the fuel injection, i.e. the fuel quantity injected and the pressure at which the fuel injection takes place, can be varied only to a limited extent during one injection cycle. In particular in an injection cycle with a preinjection and an ensuing main injection, the pressure at which the main injection begins and the time interval between the main injection and the preinjection are coupled with one another and are not freely variable. If the main injection is to begin at a low pressure, then the time interval after the preinjection is short, and if the main injection is to begin at a high pressure, then the time interval after the preinjection is long.

OBJECT AND SUMMARY OF THE INVENTION

The fuel injection system of the invention has the advantage over the prior art that by means of the blocking valve, even when the first control valve is open, an elevated pressure can be maintained in the pressure chamber and in the control pressure chamber, so that regardless of the switching state of the first control valve, a fuel injection can be controlled, particularly for a preinjection and/or a postinjection, by means of the second control valve. The pressure buildup for a main injection can be controlled by the first control valve, and the instant at which the main injection begins can be controlled by the second control valve. As a result, a decoupling between the pressure at which the main injection begins and the time interval since a preceding preinjection is made possible.

Other advantageous features and refinements of the fuel injection system of the invention are disclosed. One embodiment makes use of a simple the blocking valve possible. Another embodiment makes simple control of the pressure in the control pressure chamber possible. Another embodiment enables adjusting the fuel inflow into the control pressure chamber and the fuel outflow from the control pressure chamber, while another embodiment enables engine operation with low noise and low pollutant emissions. Another embodiment makes it simple to adjust the fuel quantity for the preinjection and to adjust the length of time that the first control valve is closed, while another embodiment makes it possible to adjust the fuel quantity for the preinjection simply and purely by mechanical means. Other variations make a postinjection possible without fuel having to be pumped by the pump piston during the postinjection, and embodiment make it simple to perform a preinjection, and enable relief of the pressure chamber and of the control pressure chamber.

BRIEF DESCRIPTION OF THE DRAWINGS

The invention will be better understood and further objects and advantages thereof will become more apparent from the ensuing detailed description of a preferred embodiment taken in conjunction with the drawings, in which.

DESCRIPTION OF THE PREFERRED EMBODIMENTS

Figure 1:
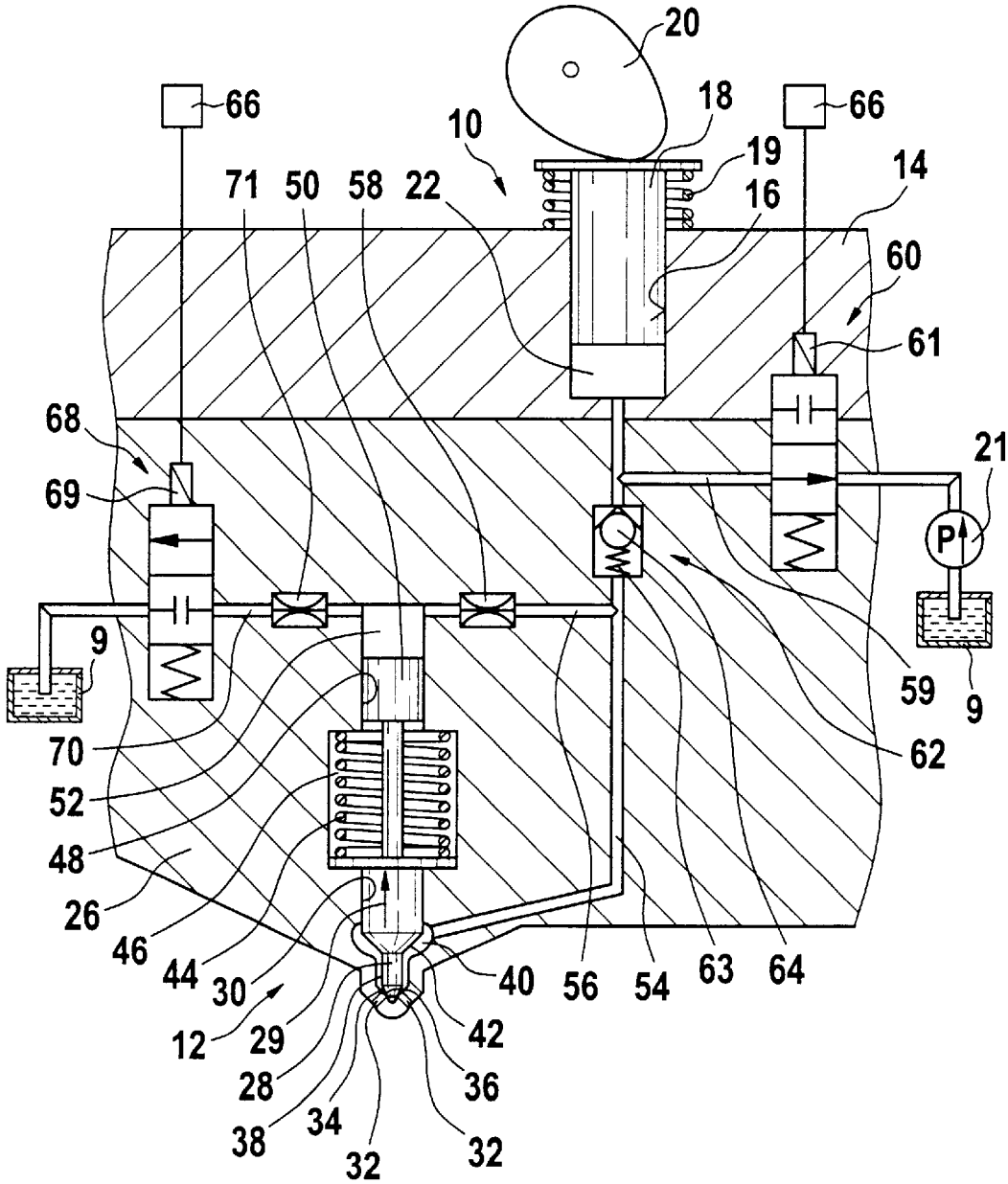
FIG. 1 schematically shows a fuel injection system embodying the invention for an internal combustion engine.

In FIG. 1, a fuel injection system for an internal combustion engine of a motor vehicle is shown. The engine is preferably a self-igniting internal combustion engine. The fuel injection system is preferably embodied as a so-called unit fuel injector, and for each cylinder of the engine it has one high-pressure fuel pump 10 and one fuel injection valve 12, communicating with it, that are combined into a unit. Alternatively, the fuel injection system can be embodied as a so-called pump-line-nozzle system, in which for each cylinder of the engine, it once again has one high-pressure fuel pump 10 and one fuel injection valve 12, communicating with it, but these are spaced apart from one another and communicate via a line. The high-pressure fuel pump 10 has a pump piston 18, guided tightly in a cylinder bore 16 of a pump body 14, and the pump piston is driven to reciprocate by a cam 20 of the engine camshaft, either directly or via a transmission element, for instance in the form of a rocking lever, counter to the force of a restoring spring 19. In the cylinder bore 16, the pump piston 18 defines a pump work chamber 22, in which fuel is compressed at high pressure in the pumping stroke of the pump piston 18. Fuel is delivered to the pump work chamber 22 from a fuel tank 9 of the motor vehicle by means of the feed pressure of a feed pump 21.

The fuel injection valve 12 has a valve body 26, which is connected to the pump body 14 and which can be embodied in multiple parts, and in which an injection valve member 28 is guided longitudinally displaceably in a bore 30. In its end region toward the combustion chamber of the cylinder of the engine, the valve body 26 has at least one and preferably a plurality of injection openings 32. The injection valve member 28, in its end region toward the combustion chamber, has a sealing face 34, for instance approximately conical in shape, which cooperates with a valve seat 36 embodied in the valve body 26 in the end region thereof toward the combustion chamber, and the injection openings 32 lead away from or downstream of this valve seat. In the valve body 26, between the injection valve member 28 and the bore 30, toward the valve seat 36, there is an annular chamber 38, which in its end region remote from the valve seat 36 changes over, as a result of a radial enlargement of the bore 30, into a pressure chamber 40 surrounding the injection valve member 28. The injection valve member 28 has a pressure shoulder 42, at the level of the pressure chamber 40, created by a cross-sectional reduction. The end of the injection valve member 28 remote from the combustion chamber is engaged by a prestressed closing spring 44, by which the injection valve member 28 is pressed toward the valve seat 36. The closing spring 44 is disposed in a spring chamber 46 of the valve body 26, which adjoins the bore 30.

The spring chamber 46, on its end remote from the bore 30, is adjoined in the valve body 26 by a further bore 48, in which a piston 50 that is connected to the injection valve member 28 is guided tightly. With its face end remote from the injection valve member 28, the piston 50 defines a control pressure chamber 52. The pressure chamber 40 has a connection 54 with the pump work chamber 22 that is formed by a conduit extending through the pump body 14 and the valve body 26. This connection 54 will hereinafter be called the pressure chamber connection 54. From the pressure chamber connection 54, a connection 56 with the control pressure chamber 52 branches off, and so the control pressure chamber 52 is likewise in communication with the pump work chamber 22. The connection 56 will hereinafter be called the control pressure chamber connection 56.

The fuel injection system has a first electrically actuated control valve 60, by which a connection 59 of the pump work chamber 22 with a relief chamber is controlled; the compression side of the feed pump 21, and hence at least indirectly the fuel tank 9, can serve as this relief chamber. The connection 59 will hereinafter be called the relief chamber connection 59. The relief chamber connection 59 branches off from the pressure chamber connection 54, upstream of the control pressure chamber connection 56 that leads to the control pressure chamber 52. In the pressure chamber connection 54, downstream of where the relief chamber connection 56 to the relief chamber 9 branches off, and upstream of where the control pressure chamber connection 56 leading to the control pressure chamber 52 branches off, there is a blocking valve, in the form of a check valve 62, which opens toward the pressure chamber 40 and closes toward the pump work chamber 22. The check valve 62 has a valve member 64 which is loaded by a closing spring 63 and is movable in the opening direction toward the pressure chamber 40, counter to the force of the closing spring 63.

The first control valve 60 has an actuator 61, which may be an electromagnet or a piezoelectric actuator and is electrically triggered and by which a valve member of the control valve 60 is movable. The first control valve 60 can be embodied as either pressure-balanced or non-pressure-balanced. The first control valve 60 is embodied as a 2/2-port directional-control valve and by it, in a first switching position, the relief chamber connection 59 with the relief chamber 9 is opened, and in a second switching position, the relief chamber connection 59 with the relief chamber 9 is disconnected. The control valve 60 is controlled by an electric control unit 66 as a function of engine operating parameters.

For controlling the pressure in the control pressure chamber 52, a second electrically actuated control valve 68 is provided, by which a connection 70 of the control pressure chamber 52 with a relief chamber, for instance at least indirectly the fuel tank 9, is controlled. The connection 70 will hereinafter be called the relief chamber connection 70. The second control valve 68 has an actuator 69, which may be an electromagnet or a piezoelectric actuator and is electrically triggered and by which a valve member of the control valve 68 is movable. The second control valve 68 is preferably embodied as pressure-balanced. The second control valve 68 is embodied as a 2/2-port directional-control valve and by it, in a first switching position, the relief chamber connection 70 of the control pressure chamber 52 with the relief chamber 9 is opened, and in a second switching position, the relief chamber connection 70 of the control pressure chamber 52 with the relief chamber 9 is disconnected. A throttle restriction 58 is provided in the control pressure chamber connection 56 of the control pressure chamber 52 with the pressure chamber connection 54, and a further throttle restriction 71 is provided in the relief chamber connection 70 of the control pressure chamber 52 with the relief chamber 9. The throttle restrictions 58, 71 make it possible to control the inflow of fuel into the control pressure chamber and the outflow of fuel from the control pressure chamber 52. The second control valve 68 is likewise controlled by the control unit 66. The control of the control valves 60, 68 is effected as a function of engine operating parameters, such as the rpm, load, and temperature.

The mode of operation of the fuel injection system will now be explained. In the intake stroke of the pump piston 18, with the first control valve 60 open, fuel is delivered to the pump work chamber 22 by the feed pump 21. In the pumping stroke of the pump piston 18, in an injection cycle, a fuel injection is effected. The injection cycle begins with a preinjection, in which a slight fuel quantity is injected at relatively low pressure. At the onset of the pumping stroke of the pump piston 18, the first control valve 60 and the second control valve 68 are closed by the control unit 66. By means of the pump piston 18, through the open check valve 62, fuel is pumped into the pressure chamber 40 and the control pressure chamber 52. The fuel injection valve 12 remains closed, because of the pressure prevailing in the control pressure chamber 52 while the second control valve 68 is closed. After a certain length of time, the first control valve 60 is opened by the control unit 66, so that the pump work chamber 22 communicates with the relief chamber 9. The check valve 62 closes in the process, so that fuel under pressure remains stored in the pressure chamber 40 and control pressure chamber 52. At a predetermined instant, the second control valve 68 is opened by the control unit 66, so that the control pressure chamber 52 is relieved, and the injection valve member 28 opens in response to the pressure prevailing in the pressure chamber 40. The preinjection is effected at the pressure level at which the fuel is stored in the pressure chamber 40. For terminating the preinjection, the second control valve 68 is closed again by the control unit 66, so that the injection valve member 28 closes as a consequence of the increased pressure in the control pressure chamber 52. By suitable opening and closure of the second control valve 68, a plurality of preinjections can also be effected at intervals from one another.

Figure 2:
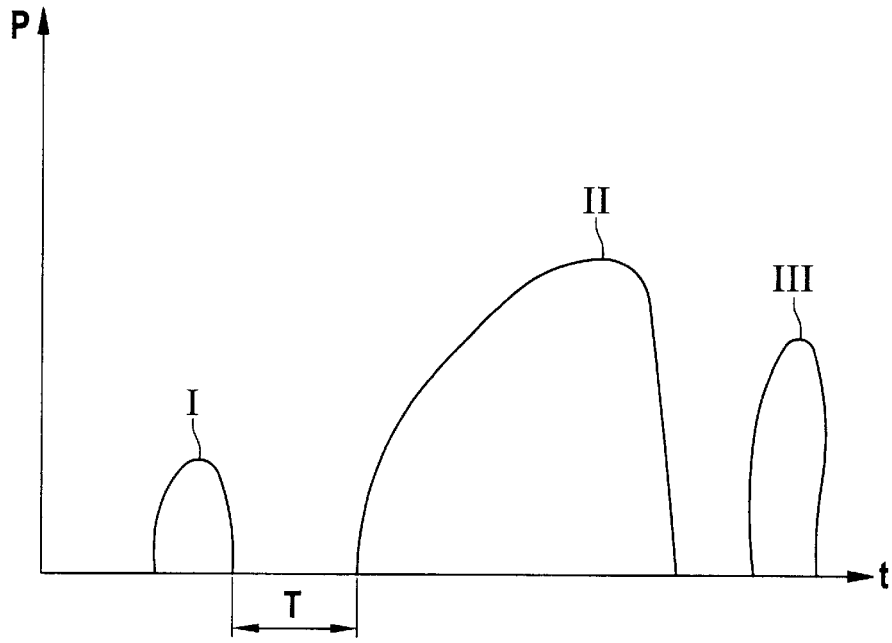
FIG. 2 shows a course of a pressure at injection openings of the fuel injection valve of the fuel injection system during one injection cycle.

In FIG. 2, the course of the pressure P at the injection openings 32 of the fuel injection valve 12 is plotted over the time t during one injection cycle. The preinjection corresponds here to the injection phase marked I in FIG. 2.

Alternatively to the preinjection, it can be provided that the first control valve 60 is closed by the control unit 66 at the onset of the pumping stroke of the pump piston 18, so that with the second control valve 68 closed, the pump piston 18 pumps fuel into the pressure chamber 40 and into the control pressure chamber 52. At a predetermined instant, when a certain fuel quantity has been pumped by the pump piston 18 into the pressure chamber 40 and the control pressure chamber 52, the first control valve 60 is opened by the control unit 66. This relieves the pump work chamber 22, and the check valve 62 closes, so that fuel remains stored under pressure in the pressure chamber 40 and in the control pressure chamber 52. At a predetermined instant, the second control valve 68 is opened by the control unit 66, so that the control pressure chamber 52 is relieved, and the injection valve member 28 opens in response to the pressure prevailing in the pressure chamber 40. The preinjection ends when the pressure in the pressure chamber 40 has dropped so sharply that the force exerted on the injection valve member 28 by the closing spring 44 is greater than the force exerted in the opening direction by the pressure prevailing in the pressure chamber 40, and the injection valve member 28 closes.

As another alternative, it can be provided that with the second control valve 68 closed, fuel from a preceding injection cycle is still stored in the pressure chamber 40 and in the control pressure chamber 52 at a pressure that is high enough for a preinjection to be performed by opening the second control valve 68. At the onset of the pumping stroke of the pump piston 18, the first control valve 60 can then remain open, since no fuel has to be pumped. The preinjection is ended by the closure of the second control valve 68 and/or when the pressure in the pressure chamber 40 has dropped so sharply that the injection valve member 28 is closed by the closing spring 44.

Figure 3:
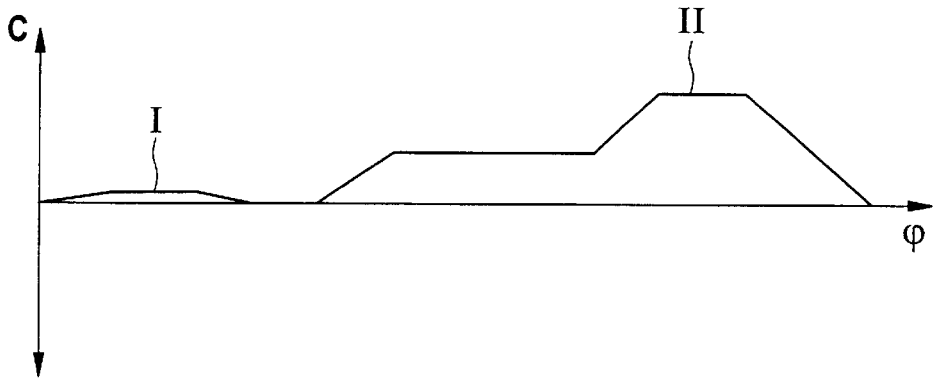
FIG. 3 shows the course of the speed of a pump piston in the fuel injection system during one injection cycle.

As still another alternative, it can be provided that the first control valve 60 is closed by the control unit 66 at the onset of the pumping stroke of the pump piston 18. The cam 20 has a shape such that over a first rotational angle range, it brings about a pumping stroke of the pump piston 18 in such a way that by means of the pump piston 18, fuel is pumped into the pressure chamber 40 and the control pressure chamber 52 while the second control valve 68 is closed. In an ensuing rotational angle range of the cam 20, this cam is shaped such that no further pumping stroke of the pump piston 18 takes place. The speed C of the pump piston 18 in its reciprocation effected by the cam 20 is plotted over the rotational angle $\phi$ of the cam 20 in FIG. 3, in which the speed in the stroke executed in the first rotational angle range is marked I, the speed in the ensuing rotational angle range of the cam 20 is zero, and the speed of a stroke effected in a further rotational angle range of the cam 20 during a main injection is marked II. The shape of the cam 20 in the first rotational angle range and the resultant stroke of the pump piston 18 determine the fuel quantity that is pumped by the pump piston 18 into the pressure chamber 40 and the control pressure chamber 52. For the preinjection, the second control valve 68 is opened by the control unit 66, and the preinjection is ended when the second control valve 68 is closed and/or when the pressure in the pressure chamber 40 has dropped so sharply that the injection valve member 28 is closed by the force of the closing spring 44.

After the preinjection, the first control valve 60 and the second control valve 68 are closed by the control unit 66. In the pumping stroke of the pump piston 18, high pressure is built up in the pressure chamber 40 and in the control pressure chamber 52, but no injection can take place yet, as long as the second control valve 68 is still closed and high pressure prevails in the control pressure chamber 52. Once a predetermined pressure, at which the main injection is to begin, is reached in the pressure chamber 40, the control unit 66 opens the second control valve 68, so that the control pressure chamber 52 is relieved. The injection valve member 28 then opens in response to the pressure prevailing in the pressure chamber 40, and the main injection begins. The main injection corresponds to an injection phase marked II in FIG. 2. For terminating the main injection, the second control valve 68 is closed by the control unit 66, so that the control pressure chamber 52 is disconnected from the relief chamber 9, and in the control pressure chamber 52, high pressure builds up, by which the injection valve member 28 is closed. In addition, upon the termination of the main injection, the first control valve 60 can also be opened by the control unit 66.

Varying the instant when the second control valve 68 is opened by the control unit 66 also varies the pressure at which the main injection begins. The earlier the second control valve 68 is opened, the less the pressure at which the main injection begins. The later the second control valve 68 is opened, the higher the pressure at which the main injection begins. By the procedures for the preinjection as explained above, it is possible for the time interval T between the preinjection and the main injection, upon a variation in the pressure at which the main injection begins, to be varied independently of this pressure. The pressure buildup for the main injection is controlled by the first control valve 60. If the main injection is to begin at a high pressure, then the first control valve is closed by the control unit 66 at an early instant after the preinjection, so that a pressure buildup ensues. The time interval between the preinjection and the main injection is determined by the instant when the control unit 66 opens the second control valve 68. If the main injection is to begin at a low pressure, then the first control valve 60 is closed by the control unit 66 at a later instant after the preinjection, so that a correspondingly delayed pressure buildup ensues. The time interval between the preinjection and the main injection is once again determined by the instant when the second control valve 68 is opened.

Alternatively, it can be provided that the second control valve 68 is already opened by the control unit 66 before the onset of the main injection, and so the control pressure chamber 52 is relieved. The first control valve 60 is closed by the control unit 66, and the main injection begins when the pressure in the pressure chamber 40 is high enough that this pressure opens the injection valve member 28 counter to the force of the closing spring 44. For terminating the main injection, the second control valve 68 is closed by the control unit, and/or the first control valve 60 is opened.

After the main injection, at least one postinjection can also be effected. After the termination of the main injection, with the second control valve 68 closed, fuel can be stored in the pressure chamber 40 and in the control pressure chamber 52. The level of the pressure at which the fuel is stored is determined by the instant of closure of the second control valve 68 upon the termination of the main injection. The earlier the second control valve 68 is closed, the higher the pressure at which the fuel is stored in the pressure chamber 40 and in the control pressure chamber 52. For a postinjection, the second control valve 68 is opened again by the control unit 66, so that the control pressure chamber 52 is relieved again and the injection valve member 28 opens. The postinjection corresponds to an injection phase marked III in FIG. 2. The postinjection is ended by the closure of the second control valve 68 by the control unit 66. It is also possible for there to be a succession of postinjections. The fuel injected in the postinjection need not be pumped by the pump piston 18 at the instant of the postinjection, but instead is drawn from the pressure chamber 40 and the control pressure chamber 52 into which fuel had already been pumped by the pump piston 18 in an earlier phase of its pumping stroke. The first control valve 60 can remain open after the termination of the main injection.

Alternatively, for the postinjection, the first control valve 60 can also be closed by the control unit 66, so that fuel is pumped into the pressure chamber 40 by the pump piston 18. If enough fuel has been stored in the pressure chamber 40 and the control pressure chamber 52 from the preceding main injection, then only some of the fuel quantity required for the postinjection has to be pumped by the pump piston 18 during the postinjection. If, with the second control valve 68 open and the control pressure chamber 52 thus relieved, the pressure in the pressure chamber 40 is high enough that the opening force of the injection valve member 28 is greater than the closing force acting on it, the postinjection then begins. The postinjection is terminated by the closure of the second control valve 68 by the control unit 66 and/or when the pressure in the pressure chamber 40 has dropped so sharply that the closing force on the injection valve member 28 is greater than the opening force generated by the pressure in the pressure chamber 40, and the injection valve member 28 closes.

After the termination of the postinjection, or if no postinjection is contemplated then after the termination of the main injection, stored fuel, with which a preinjection can be effected in the ensuing injection cycle as described above, can still be present in the pressure chamber 40 and in the control pressure chamber 42. This necessitates effective sealing of the pressure chamber 40 and the control pressure chamber 52, so that no substantial pressure drop from leakage will occur. At low engine rpm, if the duration of one injection cycle is long enough, leakage can cause the pressure in the pressure chamber 40 and in the control pressure chamber 42 to drop sharply, yet the pressure remains at least at the pressure level generated by the feed pump 21, because in that case the check valve 62 opens. It can also be provided that for terminating the main injection or the postinjection, the second control valve 68 is closed by the control unit 66 and remains closed until the pressure in the pressure chamber 40 has dropped so sharply, because of leakage, that the injection valve member 28 can no longer open even if the second control valve 68 is open. The second control valve 68 is then opened briefly, so that the pressure chamber 40 and the control pressure chamber 52 are relieved.

Figure 4:
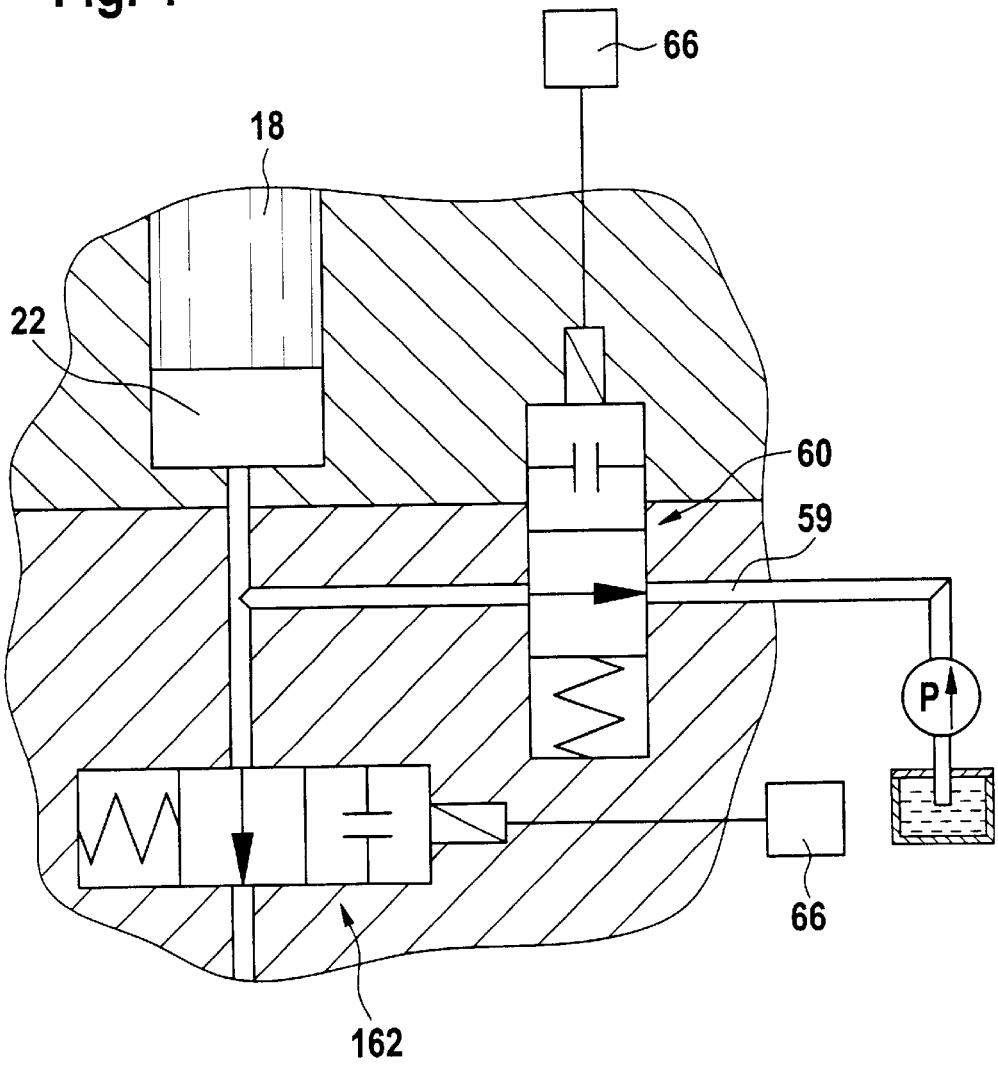
FIG. 4 shows a detail of a modified embodiment of the fuel injection system.

In FIG. 4, the fuel injection system is shown in a modified embodiment, in which the blocking valve is embodied not as a check valve 62 but as an electrically actuated control valve 162, which can be switched by the control unit 66 between an opened switching position, in which the pressure chamber connection 54 is opened, and a closed switching position, in which the pressure chamber connection 54 is disconnected. The mode of operation of the fuel injection system is the same as that described above, but the blocking valve 162 is switched actively by the control unit 66, since unlike the check valve 62, this blocking valve does not open and close automatically when a pressure difference occurs.

The foregoing relates to a preferred exemplary embodiment of the invention, it being understood that other variants and embodiments thereof are possible within the spirit and scope of the invention, the latter being defined by the appended claims.

We claim:

1. A fuel injection system for an internal combustion engine, comprising one high-pressure fuel pump (10) and one fuel injection valve (12), communicating with the pump, for each cylinder of the engine, the high-pressure fuel pump (10) having a pump piston (18) driven to reciprocate by the engine and defining a pump work chamber (22) that can be made to communicate with a pressure chamber (40) of the fuel injection valve (12), the valve (12) having an injection valve member (28) by which at least one injection opening (32) is controlled and which valve member is movable by a pressure prevailing in the pressure chamber (40), counter to a closing force (44), in an opening direction (29) for opening the at least one injection opening (32), a first electrically actuated control valve (60), by which a connection (59) of the pump work chamber (22) with a relief chamber (9; 21) is controlled at least indirectly, a second electrically actuated control valve (68), by which the pressure prevailing in a control pressure chamber (52) is controlled, by which pressure the injection valve member (28) is urged at least indirectly in the closing direction, and a blocking valve (62;162) disposed in the pressure chamber connection (54) of the pump work chamber (22) with the pressure chamber (40), the blocking valve (62;162) being operable to disconnect the pressure chamber (40) and the control pressure chamber (52) from the pump work chamber (22);

the relief chamber connection (59) of the pump work chamber (22) with the relief chamber (9), in which the first control valve (60) is disposed, leading away between the pump work chamber (22) and the blocking valve (62; 162).

2. The fuel injection system according to claim 1, wherein the blocking valve is embodied as a check valve (62) that closes toward the pump work chamber (22).

3. The fuel injection system according to claim 1, wherein the blocking valve is an electrically actuated control valve (162), which can be switched between an opened and a closed switching position.

4. The fuel injection system according to claim 1 further comprising a relief chamber connection (70) of the control pressure chamber (52) with a relief chamber (9) controlled by the second control valve (68); and a control pressure chamber connection (56) connecting the control pressure chamber (52) with the pressure chamber connection (54), the control pressure chamber connection (56) leading away, downstream of the check valve (62), from the pressure chamber connection (54) of the pump work chamber (22) with the pressure chamber (40).

5. The fuel injection system according to claim 2 further comprising a relief chamber connection (70) of the control pressure chamber (52) with a relief chamber (9) controlled by the second control valve (68); and a control pressure chamber connection (56) connecting the control pressure chamber (52) with the pressure chamber connection (54), the control pressure chamber connection (56) leading away, downstream of the check valve (62), from the pressure chamber connection (54) of the pump work chamber (22) with the pressure chamber (40).

6. The fuel injection system according to claim 3 further comprising a relief chamber connection (70) of the control pressure chamber (52) with a relief chamber (9) controlled by the second control valve (68); and a control pressure chamber connection (56) connecting the control pressure chamber (52) with the pressure chamber connection (54), the control pressure chamber connection (56) leading away, downstream of the check valve (62), from the pressure chamber connection (54) of the pump work chamber (22) with the pressure chamber (40).

7. The fuel injection system according to claim 4, further comprising a throttle restriction (58; 71) in the relief chamber connection (70) of the pressure chamber (52) with the relief chamber (9) and/or in the control pressure chamber connection (56) of the control pressure chamber (52) with the pressure chamber connection (54).

8. The fuel injection system according to claim 4 wherein at the onset of a pumping stroke of the pump piston (18), the first control valve (60) and the second control valve (68) are closed so that with the blocking valve (62; 162) open, fuel is pumped into the pressure chamber (40) and the control pressure chamber (52); wherein in the course of the pumping stroke of the pump piston (18), the first control valve (60) is opened and the blocking valve (62; 162) is closed; and wherein for at least one preinjection, the second control valve (68) is opened, so that the control pressure chamber (52) is relieved, and the injection valve member (28) opens in response to the pressure prevailing in the pressure chamber (40).

9. The fuel injection system according to claim 7 wherein at the onset of a pumping stroke of the pump piston (18), the first control valve (60) and the second control valve (68) are closed so that with the blocking valve (62; 162) open, fuel is pumped into the pressure chamber (40) and the control pressure chamber (52); wherein in the course of the pumping stroke of the pump piston (18), the first control valve (60) is opened and the blocking valve (62; 162) is closed; and wherein for at least one preinjection, the second control valve (68) is opened, so that the control pressure chamber (52) is relieved, and the injection valve member (28) opens in response to the pressure prevailing in the pressure chamber (40).

10. The fuel injection system according to claim 8, wherein, for terminating the at least one preinjection, the second control valve (68) is closed, so that the injection valve member (28) closes in response to the pressure prevailing in the control pressure chamber (52).

11. The fuel injection system according to claim 8 wherein the at least one preinjection is terminated when the pressure prevailing in the pressure chamber (40) has dropped so sharply that the injection valve member (28) closes in response to the closing force (44).

12. The fuel injection system according to claim 11 wherein upon the pumping stroke of the pump piston (18), the first control valve (60) is closed for a defined length of time in order, with the blocking valve (62; 162) open, to pump a defined fuel quantity into the pressure chamber (40) and the control pressure chamber (52), so that upon the at least one preinjection until the instant of closure of the injection valve member (28), a defined fuel quantity is injected.

13. The fuel injection system according to claim 11, wherein the pump piston (18) is driven by a cam (20); that in a first rotational angle range, the cam (20) has a predetermined shape such that the pump piston (18) executes a defined pumping stroke, and with the blocking valve (62; 162) open, pumps a defined fuel quantity into the pressure chamber (40) and the control pressure chamber (52), which quantity is injected in the preinjection; and wherein in an ensuing rotational angle range, the cam (20) has a predetermined shape such that the pump piston (18) does not execute any further pumping stroke.

14. The fuel injection system according to claim 8 wherein during the pumping stroke of the pump piston (18) after the at least one preinjection, the first control valve (60) and the second control valve (68) are closed; and wherein for an ensuing main injection, the second control valve (68) is opened, so that the control pressure chamber (52) is relieved, and the injection valve member (28) opens in response to the pressure prevailing in the pressure chamber (40).

15. The fuel injection system according to claim 8 wherein during the pumping stroke of the pump piston (18) after the at least one preinjection, the first control valve (60) is closed and the second control valve (68) is opened, so that the control pressure chamber (52) is relieved; and wherein an ensuing main injection is effected when the pressure generated in the pressure chamber (40) by the pump piston (18) with the blocking valve (62; 162) open is so high that in response to it, the injection valve member (28) opens counter to the closing force (44).

16. The fuel injection system according to claim 14 wherein for terminating the main injection, the second control valve (68) is closed.

17. The fuel injection system according to claim 15 wherein for terminating the main injection, the second control valve (68) is closed.

18. The fuel injection system according to claim 14 wherein after the main injection, at least one postinjection is effected; wherein in the preceding main injection, by closure of the second control valve (68), fuel under pressure is stored in the pressure chamber (40) and in the control pressure chamber (52); and wherein for the postinjection, the second control valve (68) is opened, so that the control pressure chamber (52) is relieved, and the injection valve member (28) opens in response to the pressure prevailing in the pressure chamber (40).

19. The fuel injection system according to claim 15 wherein after the main injection, at least one postinjection is effected; wherein in the preceding main injection, by closure of the second control valve (68), fuel under pressure is stored in the pressure chamber (40) and in the control pressure chamber (52); and wherein for the postinjection, the second control valve (68) is opened, so that the control pressure chamber (52) is relieved, and the injection valve member (28) opens in response to the pressure prevailing in the pressure chamber (40).

20. The fuel injection system according to claim 16 wherein after the main injection, at least one postinjection is effected; wherein in the preceding main injection, by closure of the second control valve (68), fuel under pressure is stored in the pressure chamber (40) and in the control pressure chamber (52); and wherein for the postinjection, the second control valve (68) is opened, so that the control pressure chamber (52) is relieved, and the injection valve member (28) opens in response to the pressure prevailing in the pressure chamber (40).

21. The fuel injection system according to claim 14 wherein, after the main injection, at least one postinjection ensues; wherein for generating pressure for the postinjection, with the blocking valve (62; 162) open, the first control valve (60) is closed; and wherein for the postinjection, the second control valve (68) is opened.

22. The fuel injection system according to claim 15 wherein, after the main injection, at least one postinjection ensues; wherein for generating pressure for the postinjection, with the blocking valve (62; 162) open, the first control valve (60) is closed; and wherein for the postinjection, the second control valve (68) is opened.

23. The fuel injection system according to claim 16 wherein, after the main injection, at least one postinjection ensues; wherein for generating pressure for the postinjection, with the blocking valve (62; 162) open, the first control valve (60) is closed; and wherein for the postinjection, the second control valve (68) is opened.

24. The fuel injection system according to claim 14 wherein after the main injection or the postinjection, at the end of an injection cycle, with the second control valve (68) closed and with the blocking valve (62; 162) closed, fuel is stored in the pressure chamber (40) and in the control pressure chamber (52) at such a high pressure that in an ensuing injection cycle, this pressure suffices to perform the preinjection with the second control valve (68) open.

25. The fuel injection system according to claim 15 wherein after the main injection or the postinjection, at the end of an injection cycle, with the second control valve (68) closed and with the blocking valve (62; 162) closed, fuel is stored in the pressure chamber (40) and in the control pressure chamber (52) at such a high pressure that in an ensuing injection cycle, this pressure suffices to perform the preinjection with the second control valve (68) open.

26. The fuel injection system according to claim 16 wherein after the main injection or the postinjection, at the end of an injection cycle, with the second control valve (68) closed and with the blocking valve (62; 162) closed, fuel is stored in the pressure chamber (40) and in the control pressure chamber (52) at such a high pressure that in an ensuing injection cycle, this pressure suffices to perform the preinjection with the second control valve (68) open.

27. The fuel injection system according to claim 21 wherein after the main injection or the postinjection, at the end of an injection cycle, with the second control valve (68) closed and with the blocking valve (62; 162) closed, fuel is stored in the pressure chamber (40) and in the control pressure chamber (52) at such a high pressure that in an ensuing injection cycle, this pressure suffices to perform the preinjection with the second control valve (68) open.

28. The fuel injection system according to claim 14 wherein after the main injection or the postinjection, at the end of an injection cycle, the second control valve (68) is opened if the pressure in the pressure chamber (40) has dropped, because of a leak, so sharply that the force generated by this pressure on the injection valve member (28) in the opening direction (29) is less than the closing force (44) acting on the injection valve member (28).

29. The fuel injection system according to claim 15 wherein after the main injection or the postinjection, at the end of an injection cycle, the second control valve (68) is opened if the pressure in the pressure chamber (40) has dropped, because of a leak, so sharply that the force generated by this pressure on the injection valve member (28) in the opening direction (29) is less than the closing force (44) acting on the injection valve member (28).

30. The fuel injection system according to claim 16 wherein after the main injection or the postinjection, at the end of an injection cycle, the second control valve (68) is opened if the pressure in the pressure chamber (40) has dropped, because of a leak, so sharply that the force generated by this pressure on the injection valve member (28) in the opening direction (29) is less than the closing force (44) acting on the injection valve member (28).

31. The fuel injection system according to claim 21 wherein after the main injection or the postinjection, at the end of an injection cycle, the second control valve (68) is opened if the pressure in the pressure chamber (40) has dropped, because of a leak, so sharply that the force generated by this pressure on the injection valve member (28) in the opening direction (29) is less than the closing force (44) acting on the injection valve member (28).

* * * * *